United States Patent [19]

Kruger

[11] 3,955,871

[45] May 11, 1976

[54] CONNECTING MEANS FOR RADIO FREQUENCY TRANSMISSION LINE

[76] Inventor: Jack L. Kruger, P.O. Box 215, Goffstown, N.H. 03045

[22] Filed: Mar. 18, 1974

[21] Appl. No.: 452,332

[52] U.S. Cl. ..... 339/92 R; 339/94 R

[51] Int. Cl.[2] ..... H01R 13/54

[58] Field of Search ..... 339/65, 92 R, 94 R, 339/94 C, 91 R, 91 P, 93 R

[56] References Cited

UNITED STATES PATENTS 2,663,753 12/1953 Bird ..... 339/65 X 3,334,326 8/1967 Besore et al. ..... 339/94 C

FOREIGN PATENTS OR APPLICATIONS 61,031 4/1968 Germany ..... 339/94 R

*Primary Examiner*—Roy Lake
*Assistant Examiner*—E. F. Desmond
*Attorney, Agent, or Firm*—C. Yardley Chittick

[57] ABSTRACT

Means for connecting together sections of a radio frequency transmission line. The connection is electrically correct, waterproof and substantially self-aligning so that even under adverse assembly conditions proper connection of the ends of the sections can be readily made.

3 Claims, 1 Drawing Figure

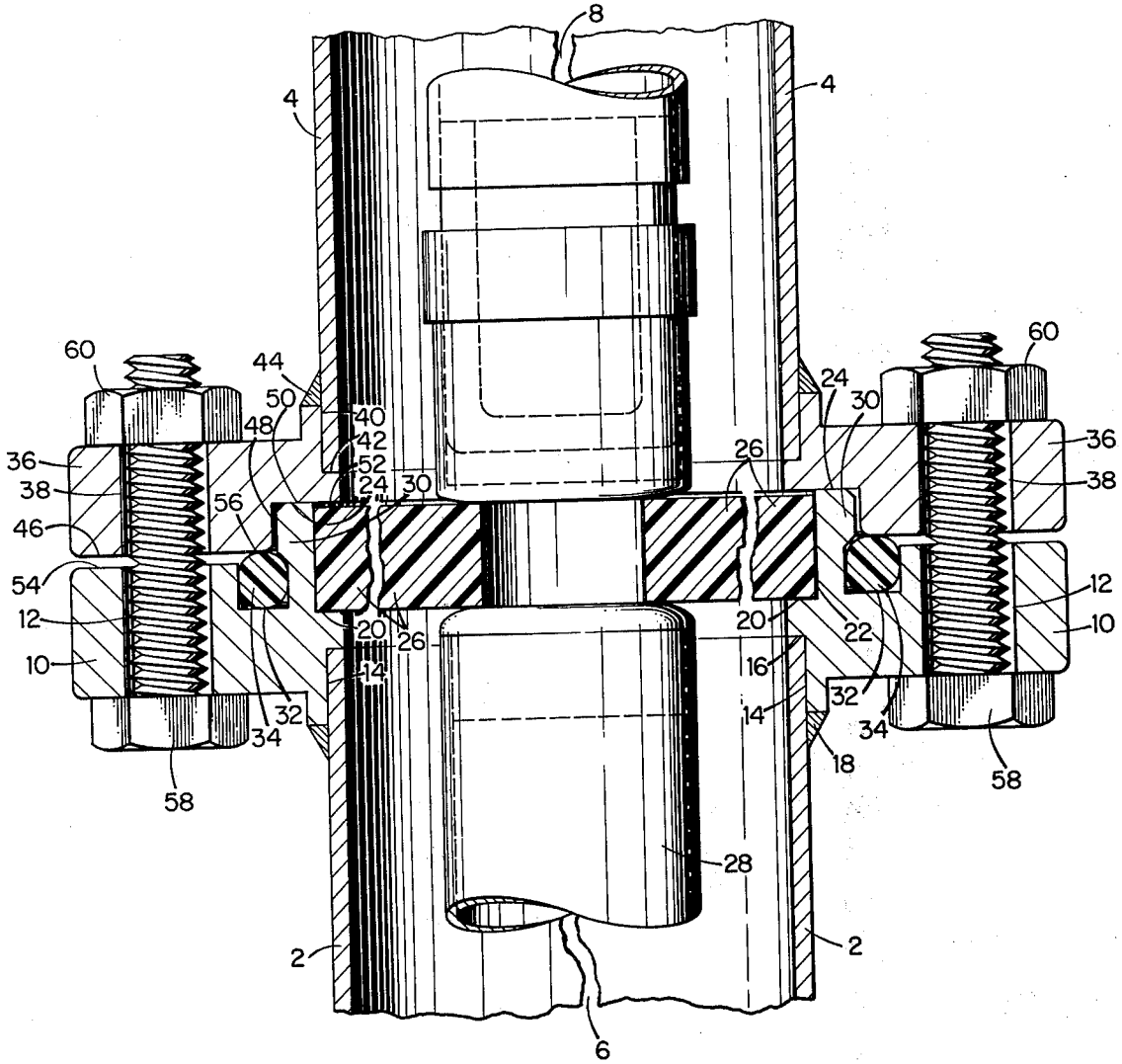
8
4
4
60
60
44
50
40
42
52
24
30
48
56
36
38
46
54
12
10
58
34
32
20
26
14
24
30
26
36
38
12
10
22
20
16
14
32
34
18
58
28
2
2
6

CONNECTING MEANS FOR RADIO FREQUENCY TRANSMISSION LINE

CROSS REFERENCE TO RELATED APPLICATION

Application of Jack L. Kruger, Ser. No. 390,746, filed Aug. 23, 1973 for Connection for Rigid Coaxial Transmission Line.

BACKGROUND OF THE INVENTION

This invention relates generally to rigid, high energy carrying coaxial transmission line equipment of the type employed in transmitting energy to a radio or television antenna. More particularly, this invention relates to a novel connector joining the outer linear sections within which are located the power carrying interior tubular conductors.

Coaxial transmission lines are generally comprised of assembled lengths of inner and outer tubular conductors held in spaced apart concentric relation with one another by a series of non-conductive spacers positioned at intervals along the length of the transmission line. The main spacer, which carries the load of the inner conductor, is usually in the form of a cylindrical disc located at the upper end of each of the outer sections.

Heretofore, the connecting construction has consisted of identical concentric flanges secured to the ends of the outer tubular sections. Each of these flanges includes a shallow circular groove in which rests a conventional O-ring. The flanges have a plurality of circumferentially spaced holes to receive bolts which hold the flanges and their related outer tubes together in proper aligned condition. Both flanges are recessed to receive therebetween a circular spacer of insulated material, usually teflon, which spacer supports the inner tubular conductor.

Experience has shown that in assembling the foregoing structure, great care must be taken to insure that the O-ring stays in the circular upper and lower grooves and that the upper edge of the spacer is not inadvertently caught under the inner edge of the upper flange.

If the flanges and O-ring are misaligned, even to a small extent, the sealing effect of the O-ring may be lost and the required electrical connection between the tubes may be diminished to adversely effect power transmission.

SUMMARY OF THE INVENTION

In the present invention, the connectors that connect the tubular sections together are complementary, rather than identical as in the prior art. One connector, the male connector, is arranged to fit within the other connector, the female connector. The construction is such that when the tubes are brought together, the connectors will automatically direct themselves to correct cooperating positions.

The outer face of the male connector has therein a deep circular groove in which an O-ring may be snugly placed with less than half of its upper portion extending above the top of the groove. A short cylindrical wall extends axially away from the inner face of the groove for a distance well beyond the O-ring. This wall has an overhanging circumferential portion which locks the O-ring in position.

The complementary female connector is circumferentially recessed about its interior to fit closely around the outer face of the short cylindrical wall. The configurations of the parts act to guide the connectors into aligned positions and at the same time to place the face of the female connector in engagement with the exposed part of the O-ring, thereby to compress the O-ring between the flanges in sealing condition.

The dimensions of the interior recess in the female connector are such that the flat annular surface of the recess will come into firm engagement with the corresponding flat annular surface on the end of the short cylindrical wall of the male connector preventing the major opposed faces of the two flanges from engaging. The two flanges when in assembled position are then bolted together to provide a weather tight and electrically perfect connection between the joined outer tubular conductors.

While the aforesaid connection between outer tubular conductors is being made, the inner tubular conductors which are concentric with the outer conductors and maintained in this concentric condition by suitable insulating spacers, likewise come into proper electrical condition as illustrated and claimed in my copending application, Ser. No. 390,746, now U.S. Pat. No. 3,818,421. However, it will be understood that the present invention may be used with any type of connectors capable of joining the ends of the inner tubular conductors.

The foregoing objects of the invention will become more apparent as the description proceeds with the aid of the accompanying single FIGURE in the drawings. This FIGURE is a vertical section taken along a diameter of the flanges and inner and outer conductors.

DESCRIPTION OF A PREFERRED EMBODIMENT

The lower outer tubular conductor is shown at 2 and the upper outer tubular conductor at 4. A typical diameter of these tubes would be about 6″. For convenience of illustration, the center portion of the outer tubes are broken away as at 6 and 8.

Connected to the upper end of tube 2 is a circular flange 10 having a plurality of bolt holes 12 equally spaced about its circumference. The inner side of the flange is recessed at 14 to receive in tight engagement therewith the upper end of tube 2. The end of tube 2 engages the annular shoulder 16. The tube and the flange are welded together as at 18. The tube 2 is preferably made of copper but in some cases may be of aluminum. The flange 10 is preferably made of brass but likewise may be of aluminum when the tube is of aluminum.

The flange 10 also has a second interior recess to provide a shoulder 20 and an inner circular surface 22. A circular insulator 26 which carries the tubular inner conductor 28, rests on shoulder 20 and fits snugly within surface 22. The axial dimension of insulator 26 is slightly less than the axial dimension of surface 22.

The circular surface 22 is the inner boundary of a circular wall 30, which is radially thicker at its outer end than at its inner end. A groove 32 extends circumferentially about the flange and this groove is adapted to receive an O-ring 34, which to be placed in the groove must be stretched over the thicker outer part of wall 30. It will be understood that when the O-ring 34 has been positioned in groove 32 it will remain there without any possibility of dislodgment during assembly of the parts.

The other flange 36 which is attached to the lower end of tube 4 has the same outer diameter as the flange 10 and the same number of bolt holes 38 which can be brought into alignment with the bolt holes 12 in the lower flange. The interior portion of flange 37 is recessed as at 40 to receive the lower portion of tube 4. The lower end of tube 4 sits on the shoulder 42. With the parts thus positioned, they are welded together as at 44. In this condition the lower surface 46 of flange 36 will lie in a plane at right angles to the axis of tubes 2 or 4 and will be parallel to the upper surface of flange 10.

The interior of flange 36 is also recessed to form a cylindrical surface 48 which is slightly larger in diameter than the adjacent outer diameter of wall 30. The annular surface 50 that extends radially inward from the cylindrical surface 48 reaches to a position in which it overlies the top edge of spacer 26 so that when the parts are assembled, the spacer 26 is locked between shoulders 20 and 52.

The vertical dimension of surface 48 is such that when annular surface 50 is in tight engagement with the upper annular surface 24 of wall 30, the underside 46 of flange 36 will be spaced from the upper surface 54 of the flange 10, but the interior annular surface portion 56 of flange 36 will have come into engagement with the top part of O-ring 34 and will have compressed the O-ring so that it is in tight engagement with the walls of groove 32 and the surface 56. This arrangement creates a water tight seal between the two flanges 10 and 36.

It will be noticed that the outer circular corner of wall 30 is beveled and the annular corner at the lower edge of cylindrical surface 48 is likewise beveled. Thus, when the two tubes 2 and 4 are being brought together for assembly, the female flange 36 easily drops into correct position about the upwardly extending wall 30 of the male flange. The face of the upper flange necessarily comes into proper compressing engagement with O-ring 34 and the shoulder 52 correctly overlies the upper periphery of spacer 26. The bolt holes 12 and 38, if not in exact alignment, may be brought into alignment by limited rotation of tube 4. Then bolts 58 may be placed in the bolt holes and the nuts 60 screwed thereon to hold the flanges together in permanent relation.

In this way, with the assembly complete, there will be prefect electrical connection between tubes 2 and 4 by virtue of the engagement of annular surfaces 24 and 50. At the same time, the joint will be water tight because of the compressed engagement of O-ring 34 with the related parts of flanges 10 and 36.

In the foregoing description it has been assumed that the tubes 2 and 4 are in vertical position, but it is to be understood that the tubular sections may also be arranged in horizontal or sloping position. Thus, for purposes of description, the upper end of each tube is that end of the tube which is most remote from the transmitter regardless of the positions of the tubes in space. Similarily, while it has been found generally preferable to have the male flange on the upper end of the outer tubular conductor and the female flange on the opposed lower end of the next outer conductor, the flanges, of course, could be reversed without changing the electrical or waterproofing characteristics. The connected tubular sections may be straight, curved as elbows or otherwise.

In the Claims when reference is made to the face of the flange, it means that annular surface of the flange that opposes the face of the other flange.

It will be understood that various changes in the details, materials and arrangement of parts which have herein been illustrated in order to explain the nature of the invention may be made by those skilled in the art within the scope of the appended claims.

I claim:

1. Means for connecting together the outer uniform diameter tubular sections of a radio frequency transmission line and for supporting an inner tubular conductor in spaced relation therewithin, said means comprising a first circular flange connected to the end of one outer tubular section and a second circular flange connected to the adjacent end of the next outer tubular section, both flanges having a plurality of bolt holes therethrough spaced radially and angularly for mutual alignment, a circular groove in the face of said first flange, a circular wall extending above the face of said first flange, the outer circular face of said wall defining an extension of the inner circular wall of said groove, said outer circular face being of greater diameter than the said inner circular wall of said groove, the inner circular face of said wall defining a short cylindrical surface of greater diameter than the interior diameter of said tubular sections, a circular shoulder at one end of said short cylindrical surface, a circular spacer located within said short cylindrical surface and supported by said circular shoulder, an inner tubular conductor carried by said spacer in radially spaced relation to said first and second flanges and said tubular section, an O-ring in said groove with part of said O-ring extending above the face of said first flange, said second flange having a recess about its interior periphery defined by an annular surface adapted to engage the end of said raised circular wall and by a cylindrical surface extending from the said annular surface to the face of said second flange, said last named cylindrical surface sized to closely surround the outer circular face of said wall and having an axial dimension less than the distance from the end of said raised circular wall to the face of said first flange, the inner part of the annular face of said second flange adapted to engage the exposed part of said O-ring, the dimensions being such that when said annular face of the recess is in engagement with the end of said wall, said O-ring will be compressed by the inner part of the annular face of said second flange to create a seal between said first and second flanges, said second flange having a circular interior part which extends radially inward far enough to overlie the periphery of said spacer thereby to anchor said spacer in position between said flanges, both said flanges having interior circular recesses in which reside the ends of said adjacent tubular outer sections.

2. Means for connecting together the outer tubular sections of a radio frequency transmission line, said means comprising a first circular flange connected to the end of one tubular section and a second circular flange connected to the adjacent end of the next tubular section, both flanges having a plurality of bolt holes therethrough spaced radially and angularly for mutual alignment, a circular groove in the face of said first flange, a circular wall extending above the face of said first flange, the outer face of said wall defining an extension of the inner wall of said groove, the inner face of said wall defining a short cylindrical surface within which may be positioned a circular spacer, a circular shoulder at one end of said cylindrical surface for engaging and holding said spacer, an O-ring in said groove with part of said O-ring extending above the face of said first flange, said second flange having a recess about its interior periphery defined by an annular surface adapted to engage the end of said raised circular wall and by a cylindrical surface extending from the said annular surface to the face of said second flange, said cylindrical surface sized to closely surround the outer face of said wall, the inner part of the face of said second flange adapted to engage the exposed part of said O-ring, the dimensions being such that when said annular face of the recess is in engagement with the end of said wall, said O-ring will be compressed by the face of said second flange to create a seal between said first and second flanges, said second flange having a circular interior part which extends radially inward far enough to overlie the periphery of said spacer thereby to anchor said spacer in position between said flanges, the distance between the circular shoulder of said first flange and the circular interior part of said second flange when the flanges are assembled being greater than the thickness of said spacer.

3. A construction whereby the adjacent ends of outer tubular sections of a radio frequency transmission line may be connected together to provide a water tight joint and whereby an inner tubular power carrying conductor is supported within the connection, said construction comprising, a first circular flange having first and second annular faces and having a first interior circular recess with a first annular shoulder in which is positioned the end of one of said outer tubular sections, a second interior circular recess in said first flange axially spaced from said first recess and having a second annular shoulder a circular spacer of dielectric material positioned against said second annular shoulder, an inner tubular conductor carried by said spacer and axially aligned with said outer tubular sections and spaced therefrom, a circular wall integral with said first flange, the inner circular surface of said wall comprising the circular face of said second interior circular recess, the outer circular face of said wall extending from a position beyond the said second annular face of said first flange to a position in said first flange below the said second annular face, said first flange having a circular groove surrounding that part of the outer circular face of said wall that is below the said second annular face of said first flange, an O-ring in said circular groove with part thereof extending above said second annular face, a second circular flange in face to face cooperating relationship with said first flange, said second flange having third and fourth annular faces and having a third interior circular recess with a third annular shoulder in which is positioned the end of the other of said adjacent outer tubular sections, a fourth interior circular recess in said second flange axially spaced from said third recess and having a fourth annular shoulder, the said fourth annular shoulder having a radial dimension which causes it to overlap the periphery of said spacer and the end of said circular wall, the said fourth interior circular recess also having a cylindrical surface which overlaps that part of said circular wall which extends above the said second face of said first flange, means for drawing said flanges tightly together, the dimensions of the various parts being such that when the said fourth annular shoulder is in tight engagement with the end of said circular wall, the said fourth annular face of said second flange will press tightly against said O-ring and there will be clearance between said second and fourth faces of said first and second flanges respectively and said spacer will be positively located between said second and fourth annular shoulders.

* * * * *

UNITED STATES PATENT AND TRADEMARK OFFICE

CERTIFICATE OF CORRECTION

PATENT NO. : 3,955,871

DATED : May 11, 1976

INVENTOR(S) : Jack L. Kruger

It is certified that error appears in the above-identified patent and that said Letters Patent are hereby corrected as shown below:

Column 4, lines 11, 12 and 13, cancel "both flanges having a plurality of bolt holes therethrough spaced radially and angularly for mutual alignment,".

Column 4, line 40, change "face" to - - surface - -.

Column 4, line 41, after "said" insert - - circular - -.

Column 4, line 49, change the period to a comma and add - - and means for drawing said flanges tightly together to maintain the said annular surface in tight engagement with the end of said circular wall and to maintain said O-ring in compressed condition. - -.

Column 4, lines 55, 56 and 57, cancel "both flanges having a plurality of bolt holes therethrough spaced radially and angularly for mutual alignment,".

Column 5, line 17, change the period to a comma and add - - and means for drawing said flanges tightly together to maintain the said annular surface in tight engagement with the end of said circular wall and to maintain said O-ring in compressed condition. - -.

Signed and Sealed this

Fifth Day of October 1976

[SEAL]

*Attest:*

RUTH C. MASON
*Attesting Officer*

C. MARSHALL DANN
*Commissioner of Patents and Trademarks*